US010774284B2

(12) United States Patent
Karve et al.

(10) Patent No.: US 10,774,284 B2
(45) Date of Patent: Sep. 15, 2020

(54) GREASE AND METHODS OF MAKING THE SAME

(71) Applicant: Afton Chemical Corporation, Richmond, VA (US)

(72) Inventors: Anand Karve, Mumbai (IN); Vishal Nandurkar, Mumbai (IN)

(73) Assignee: Afton Chemical Corporation, Richmond, VA (US)

( * ) Notice: Subject to any disclaimer, the term of this patent is extended or adjusted under 35 U.S.C. 154(b) by 66 days.

(21) Appl. No.: 15/872,518

(22) Filed: Jan. 16, 2018

(65) Prior Publication Data

US 2019/0218470 A1 Jul. 18, 2019

(51) Int. Cl.

| | |
|---|---|
| ***C10M 141/08*** | (2006.01) |
| ***C10M 129/32*** | (2006.01) |
| ***C10M 135/10*** | (2006.01) |
| ***C10M 129/54*** | (2006.01) |
| ***C10M 129/16*** | (2006.01) |
| ***C10M 169/04*** | (2006.01) |
| ***C10M 163/00*** | (2006.01) |
| *C10N 10/04* | (2006.01) |
| *C10N 30/06* | (2006.01) |
| *C10N 30/00* | (2006.01) |
| *C10N 50/10* | (2006.01) |

(52) U.S. Cl.

CPC ..... *C10M 141/08* (2013.01); *C10M 129/16* (2013.01); *C10M 129/32* (2013.01); *C10M 129/54* (2013.01); *C10M 135/10* (2013.01); *C10M 163/00* (2013.01); *C10M 169/04* (2013.01); *C10M 2207/046* (2013.01); *C10M 2207/122* (2013.01); *C10M 2207/1225* (2013.01); *C10M 2207/144* (2013.01); *C10M 2219/044* (2013.01); *C10M 2219/046* (2013.01); *C10N 2010/04* (2013.01); *C10N 2030/06* (2013.01); *C10N 2030/52* (2020.05); *C10N 2050/10* (2013.01)

(58) Field of Classification Search

CPC ..... C10M 141/08; C10M 129/32; C10M 135/10; C10M 129/16; C10M 169/04; C10M 163/00; C10M 2207/122; C10M 2219/046; C10M 2219/044; C10M 2207/144; C10M 2207/046; C10M 2207/1225; C10N 2250/10; C10N 2210/02; C10N 2230/06; C10N 2230/52

See application file for complete search history.

(56) References Cited

U.S. PATENT DOCUMENTS 3,318,807 A * 5/1967 Lyons ..... C10M 5/00 508/164
3,446,736 A * 5/1969 Herd ..... C10L 1/2493 508/393
3,671,012 A 6/1972 Scott et al.
3,909,426 A * 9/1975 Horodysky ..... C10M 5/00 508/512

(Continued)

OTHER PUBLICATIONS

International Search Report for PCT/US2019/013814, dated May 10, 2019.

*Primary Examiner* — Cephia D Toomer
(74) *Attorney, Agent, or Firm* — Barnes & Thornburg LLP

(57) ABSTRACT

The present disclosure relates to a high performance calcium sulfonate greases with enhanced performance benefits and methods for making the same.

38 Claims, 5 Drawing Sheets

(56) References Cited

U.S. PATENT DOCUMENTS

| | | | | |
|---|---|---|---|---|
| 4,560,489 | A | 12/1985 | Muir et al. | |
| 5,602,084 | A | 2/1997 | Moreton | |
| 2007/0004602 | A1* | 1/2007 | Waynick ..... | C10M 125/10<br>508/392 |
| 2015/0252283 | A1 | 9/2015 | Sekiguchi et al. | |

* cited by examiner

GREASE AND METHODS OF MAKING THE SAME

FIELD OF THE INVENTION

The present disclosure relates to a high performance calcium sulfonate greases with enhanced performance benefits and methods for making the same.

BACKGROUND OF THE INVENTION

Overbased calcium sulfonate greases have been an established grease category for many years. One known process for making such greases is a two-step process involving the steps of "promotion" and "conversion." Typically, the first step ("promotion") is to react a stoichiometric excess amount of calcium oxide (CO) or calcium hydroxide ($Ca(OH)_2$) as the base source with an alkyl benzene sulfonic acid, carbon dioxide ($CO_2$), and with other components to produce an oil-soluble overbased calcium sulfonate with amorphous calcium carbonate dispersed therein. Typically the second step ("conversion") is to add a converting agent or agents, such as propylene glycol, isopropyl alcohol, water, formic or acetic acid, to the production of the promotion step, along with a suitable base oil (such as mineral oil), to convert the amorphous calcium carbonate to a very finely divided dispersion of crystalline calcium carbonate, also known as a colloidal dispersion, that interacts with the calcium sulfonate to form a grease-like consistency. Such overbased calcium sulfonate greases produced through the two-step process have come to be known as "simple calcium sulfonate greases" and are disclosed, for example, in U.S. Pat. Nos. 3,242,079, 3,372,115, 3,376,222, 3,377,283 and 3,492,231.

It is also possible to combine the promoting and conversion steps into a single step by carefully controlling the reaction. In this one-step process, the simple calcium sulfonate grease is prepared by reaction of an appropriate sulfonic acid with either calcium hydroxide or calcium oxide in the presence of carbon dioxide and a system of reagents that simultaneously act as both promoter (creating the amorphous calcium carbonate overbasing by reaction of carbon dioxide with an excess amount of calcium oxide or calcium hydroxide) and converting agents (converting the amorphous calcium carbonate to very finely divided crystalline calcium carbonate). Thus, the grease-like consistency is formed in a single step wherein the overbased, oil-soluble calcium sulfonate (the product of the first step in the two-step process) is never actually formed and isolated as a separate product. One-step processes are disclosed, for example, in U.S. Pat. Nos. 3,661,622, 3,671,012, 3,746,643, and 3,816,310.

In addition to simple calcium sulfonate greases, calcium sulfonate complex greases have been prepared. These complex greases are typically produced by adding a strong calcium-containing base, such as calcium hydroxide or calcium oxide, to the simple calcium sulfonate grease produced by either the two-step or one-step process, and reacting with stoichiometrically equivalent amounts of complexing acids such as 12-hydroxystearic acid (12-HSA), boric acid, acetic acid, or phosphoric acid. Some advantages of calcium sulfonate complex greases over the simple greases include reduced tackiness, improved pumpability, and improved high temperature utility. Calcium sulfonate complex greases are disclosed, for example, in U.S. Pat. Nos. 4,560,489, 5,126,062, 5,308,514 and 5,338,467.

Calcium oxide or calcium hydroxide can be used as the source of basic calcium for production of calcium sulfonate greases or as a required component for reacting with complexing acids to form calcium sulfonate complex greases. However, the presence of calcium carbonate as a separate ingredient or as an "impurity" in the calcium hydroxide or calcium oxide, other than that presence of the amorphous calcium carbonate dispersed in the calcium sulfonate after carbonation, is undesirable for at least two reasons. The first reason is calcium carbonate is generally a weak base, unsuitable for reacting with complexing acids. The second reason is the presence of unreacted solid calcium compounds (including calcium hydroxide or calcium oxide) interferes with the conversion process, resulting in inferior grease compounds if the unreacted solids are not removed prior to conversion or before conversion is completed.

It is desirable to have calcium sulfonate complex grease compositions with worked penetration of National Lubricating Grease Institute (NLGI) categorization 1-3, suitable dropping points for higher temperature applications and lower amounts of overbased calcium sulfonate to reduce material cost. It is further desirable to have methods of manufacture for such greases that reduce process time and employ open kettle manufacturing processes to eliminate the need for pressure reactors.

SUMMARY OF THE INVENTION

The present invention provides overbased calcium sulfonate complex greases that have desirable performance characteristics and improved methods for making the same.

One aspect described herein is a complex grease comprising preformed calcium acetate from about 0.25 wt % to about 5 wt %, an overbased calcium sulfonate detergent from about 10 wt % to about 30 wt %, and an oil of lubricating viscosity.

Another aspect described herein is a method for preparing a calcium sulfonate grease comprising the steps of a) providing preformed calcium acetate dissolved in water in a vessel, b) providing an oil of lubricating viscosity to the dissolved preformed calcium acetate in water in the vessel from step a), c) heating the oil and preformed calcium acetate mixture of step b), and d) providing an overbased calcium sulfonate detergent to the oil and preformed calcium acetate mixture in the vessel from step c).

A third aspect is a grease prepared by one or more of the methods described herein.

DETAILED DESCRIPTION OF THE INVENTION

Figure 1:
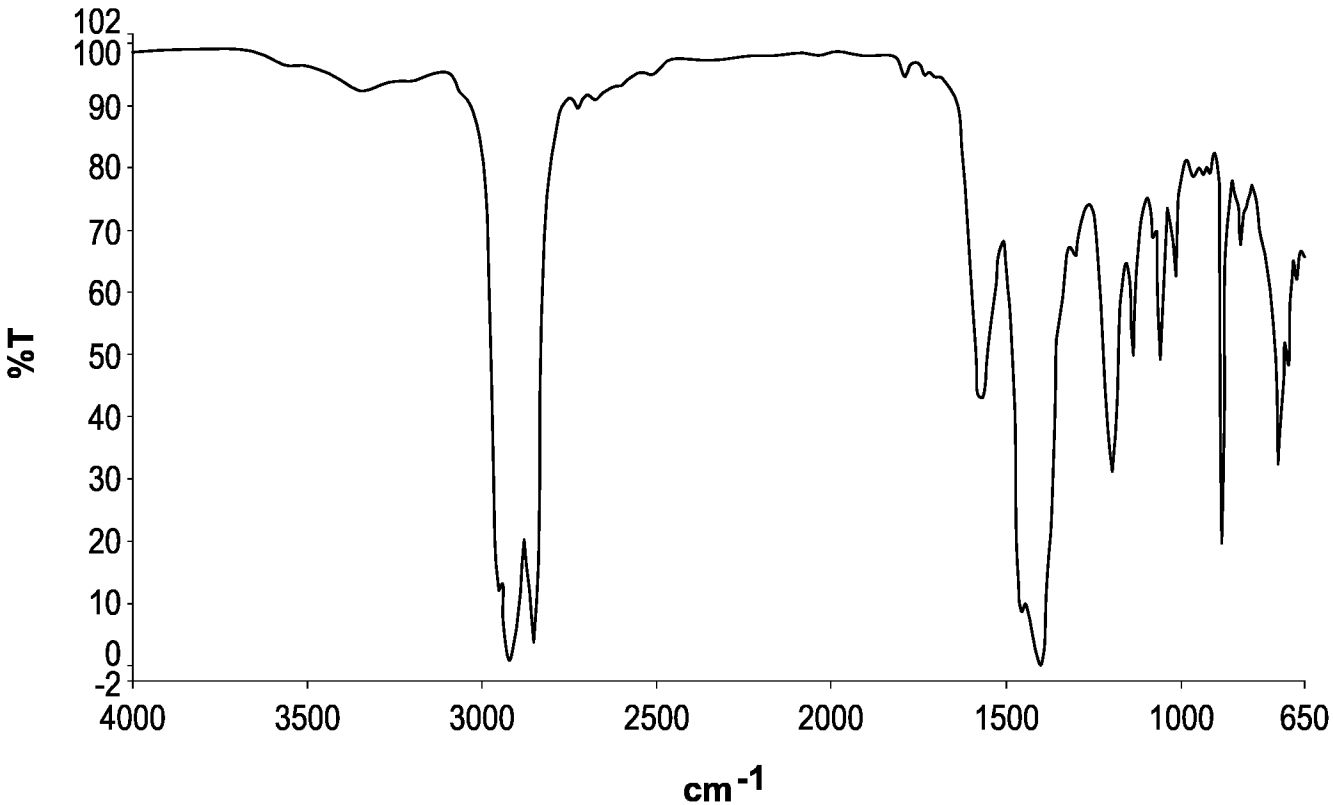
FIG. 1 is an FTIR spectrum of an embodiment described herein.

The invention disclosed herein relates to novel, overbased calcium sulfonate complex greases and improved methods for making the same. The complex greases of the invention have desirable performance properties and contain lower amounts of oil-soluble overbased calcium sulfonate as compared to many prior art greases and, therefore, are economically favorable.

As used herein, the phrase "total base number" or "TBN" refers to the quantity of acid, expressed in terms of the equivalent number of milligrams of potassium hydroxide, required to neutralize all basic constituents present in 1 gram of sample.

As used herein "absorbance intensity" refers to % transmittance as a function of wavenumber for a particular peak.

As used herein the term "preformed calcium acetate" refers to anhydrous, hemi-hydrated or hydrated calcium acetate in powder form or dissolved in water, as well as calcium acetate dissolved in water that is prepared from a reaction of calcium carbonate or calcium hydroxide with acetic acid, preferably glacial acetic acid, in the absence of a base oil or carbon dioxide. As used herein, the term "preformed calcium acetate" does not include calcium acetate formed "in situ" during a grease preparation process, for example, from the reaction of an acid with a basic calcium source, for example a calcium sulfonate detergent, in the presence of carbon dioxide or a base oil.

As used herein, the term "about" means, with respect to an amount, approximate or almost, and includes the exact amount. For example, the phrase "about 1.0%" means not only approximately or almost 1.0% but also includes exactly 1.0%.

One aspect described herein is a complex calcium sulfonate grease comprising preformed calcium acetate from about 0.25 wt % to about 5 wt %, an overbased calcium sulfonate detergent from about 10 wt % to about 30 wt %, and an oil of lubricating viscosity.

The calcium acetate of the greases of the present invention is preformed calcium acetate. The amount of preformed calcium acetate in the grease according to the present disclosure is between about 0.1 wt. % to about 25 wt. %, between about 0.25 wt. % to about 10 wt. %, between about 0.25 wt. % to about 5 wt. % based on the total weight of the grease. In one embodiment the amount of preformed calcium acetate is between 0.5 wt. % to about 3.5 wt. % based on the total weight of the complex grease.

The grease comprises one or more neutral, overbased calcium sulfonate detergents. The overbased oil-soluble calcium sulfonate detergent used according to the present disclosure has a TBN value of at least 200, or at least 300, and preferably not more than 400. In one embodiment, the overbased calcium sulfonate detergent has a TBN of from about 300 to about 400. Commercially available overbased calcium sulfonate detergents of this type include but are not limited to, the following: HiTEC 611® as supplied by Afton Chemical, Hybase C401 as supplied by Chemtura USA Corporation, and Syncal OB 400 and Syncal OB405-WO as supplied by Kimes Technologies International Corporation, and LZ 5358, a 400 TBN detergent as supplied by Lubrizol.

The amount of the overbased oil-soluble calcium sulfonate detergent in the final grease according to the present disclosure can vary, but will generally be between about 5 wt. % to about 30 wt. %, between about 10 wt. % to about 30 wt. % based on the total weight of the grease. In one embodiment, the amount of overbased calcium sulfonate detergent is between about 20 wt. % to about 30 wt. % based on the total weight of the grease.

In one embodiment, the range of the ratio of preformed calcium acetate to overbased calcium sulfonate detergent is from about 1:2 to about 1:100. In another embodiment, the range of the ratio of preformed calcium acetate to calcium sulfonate is about 1:5 to about 1:55.

The greases of the present disclosure comprise at least one oil of lubricating viscosity or base oil. As used herein, the term "oil of lubricating viscosity", "base oil" or "base stock" refers to oils categorized by the American Petroleum Institute (API) category groups Group I-V oils as well as animal oils, vegetable oils (e.g. castor oil and lard oil), petroleum oils, mineral oils, synthetic oils, and oils derived from coal or shale. The American Petroleum Institute has categorized these different base stock types as follows: Group I, greater than 0.03 wt percent sulfur, and/or less than 90 vol percent saturates, viscosity index greater than or equal to 80 and less than 120; Group II, less than or equal to 0.03 wt percent sulfur, and greater than or equal to 90 vol percent saturates, viscosity index greater than or equal to 80 and 120; Group III, less than or equal to 0.03 wt percent sulfur, and greater than or equal to 90 vol percent saturates, viscosity index greater than or equal to 120; Group IV, all polyalphaolefins; Group V base stock encompasses all other base stocks which cannot be classified as Group I, II, III, or IV base stocks. Group V base stocks include but are not limited to naphthenic oils and esters. Hydrotreated base stocks and catalytically dewaxed base stocks, because of their low sulfur and aromatics content, generally fall into the Group II and Group III categories. Polyalphaolefins (Group IV basestocks) are synthetic base oils prepared from various alpha olefins and are substantially free of sulfur and aromatics.

Groups I, II, and III are mineral oil process stocks. Group IV base oils contain true synthetic molecular species, which are produced by polymerization of olefinically unsaturated hydrocarbons. Many Group V base oils are also true synthetic products and may include diesters, polyol esters, polyalkylene glycols, alkylated aromatics, polyphosphate esters, polyvinyl ethers, and/or polyphenyl ethers, and the like, but may also be naturally occurring oils, such as vegetable oils. It should be noted that although Group III base oils are derived from mineral oil, the rigorous processing that these fluids undergo causes their physical properties to be very similar to some true synthetics, such as PAOs. Therefore, oils derived from Group III base oils may sometimes be referred to as synthetic fluids in the industry. In an embodiment of the present invention, the base oil is an oil selected from Groups I, II, III IV and V. In certain embodiments, the base oil is a mixture of one or more oils selected from Groups I, II, III, IV and V. Mixtures of base oils include mixtures of two or more base oils from the same group, two or more base oils from different groups, and any number of base oils from any of Groups I, II, III, IV and V.

The amount of base oil or oil of lubricating viscosity in the final grease according to the present disclosure may vary broadly, but will generally comprise from about 5 wt % to about 95 wt % based on the total weight of the grease. In one embodiment, the base oil will comprise from about 15% wt % to about 60 wt %.

In one embodiment, the grease further comprises one or more complexing acids. In some embodiments, the grease comprises at least two complexing acids. Complexing acids comprise at least one or more long chain carboxylic acids, short chain carboxylic acids, boric acid, phosphoric acid or sulfonic acid. Long chain carboxylic acids suitable for use according to the present disclosure comprise aliphatic carboxylic acids with at least 16 carbon atoms and include 12-hydroxystearic acid (12-HSA) and are present from about 0.5 wt % to about 5 wt % based on the final weight of the grease. Short chain carboxylic acids suitable for greases of the present disclosure comprise aliphatic carboxylic acids with no more than 8 carbon atoms, and preferably no more than 4 atoms. In one embodiment, the short chain carboxylic acid is acetic acid. In another embodiment, short chain carboxylic acids are present from about 0.5 wt % to about 2 wt % based on the final weight of the grease.

Boric acid may be used as a complexing acid according to the present disclosure, in an amount from about 0.4 wt % to about 4 wt % based on the final weight of the grease. The boric acid may be added after first being dissolved or slurried in water, or it can be added without water. Preferably, the boric acid is added during the manufacturing process such that water is still present. Alternatively, any of the well-known inorganic boric acid salts may be used instead of boric acid. Likewise, any of the established borated organic compounds such as borated amines, borated amides, borated esters, borated alcohols, borated glycols, borated ethers, borated epoxides, borated ureas, borated carboxylic acids, borated sulfonic acids, borated expoxides, borated peroxides and the like may be used instead of boric acid. If phosphoric acid acid is used as a complexing agent, it is used in an amount from about 0.4 wt % to about 4 wt % based on the final weight of the grease.

The complexing acid may also be alkyl benzene sulfonic acid, having an alkyl chain lengthy typically between about 1 to 20 carbons, which may help to facilitate efficient grease structure formation. In one embodiment, the alkyl benzene sulfonic acid comprises a mixture of alkyl chain lengths that are mostly about 12 carbons in length. In one embodiment, the benzene sulfonic acid is dodecylbenzene sulfonic acid ("DDBSA"). Commercially available benzene sulfonic acids of this type include JemPak 1298 Sulfonic Acid as supplied by JemPak GK Inc., Calsoft LAS-99 as supplied by Pilot Chemical Company, and Biosoft S-101 as supplied by Stepan Chemical Company. When the alkyl benzene sulfonic acid is used as described in the present disclosure, it is added in an amount from about 0.5 wt % to about 5 wt % based on the final weight of the grease.

The percentages of various complexing acids described herein refer to pure, active compounds. If any of these complexing acids are available in a diluted form, they may still be suitable for use in the present invention. However, the percentages of such diluted complexing acids will need to be adjusted so as to take into account the dilution factor and bring the actual active material into the specified percentage ranges.

The grease of the present disclosure may further comprise one or more converting agents, such as alcohols, ethers, glycols, glycol ethers, glycol polyethers, carboxylic acids, inorganic acids, organic nitrates, and any other compounds that contain either active or tautomeric hydrogen. The converting agents are used in an amount from about 0.1 wt % to about 5 wt % based on the final weight of the grease. Depending on the converting agents used, they may be removed by volatilization during the manufacturing process. In one embodiment the complexing agent is an alcohol. In another embodiment, the complexing agent is selected from isopropyl alcohol and ethoxy ethanol. In one embodiment, the complexing agent is 2-ethoxyethanol.

The grease of the present disclosure may further comprise additional lubricant performance additives. The additives include, but not limited to, antioxidants, metal deactivators, metal passivators, chelating agents, polymers, chemical markers, fragrance imparters, evaporative solvents, anti-scuffing agents, foam inhibitors, demulsifiers, friction modifiers, corrosion inhibitors, antiwear agents, pour point depressants, tackiness agents, extreme pressure agents, viscosity modifiers, oxidation inhibitors, rust inhibitors, dyes and like. Such components may be present in the fully formulated grease composition in amount ranging from about 1 wt. % to about 10 wt. % based on the final weight of the composition.

Antioxidants

Antioxidant compounds are known and include, for example, phenates, phenate sulfides, sulfurized olefins, phosphosulfurized terpenes, sulfurized esters, aromatic amines, alkylated diphenylamines (e.g., nonyl diphenylamine, di-nonyl diphenylamine, octyl diphenylamine, di-octyl diphenylamine), phenyl-alpha-naphthylamines, alkylated phenyl-alpha-naphthylamines, hindered non-aromatic amines, phenols, hindered phenols, oil-soluble molybdenum compounds, macromolecular antioxidants, or mixtures thereof. A single antioxidant or a combination of two or more can be used.

The hindered phenol antioxidant may contain a secondary butyl and/or a tertiary butyl group as a sterically hindering group. The phenol group may be further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In an embodiment the hindered phenol antioxidant may be an ester and may include, e.g., an addition product derived from 2,6-di-tert-butylphenol and an alkyl acrylate, wherein the alkyl group may contain about 1 to about 18, or about 2 to about 12, or about 2 to about 8, or about 2 to about 6, or about 4 carbon atoms.

Useful antioxidants may include diarylamines and high molecular weight phenols. In an embodiment, the grease composition may contain a mixture of a diarylamine and a high molecular weight phenol, such that each antioxidant may be present in an amount sufficient to provide up to about 5%, by weight of the antioxidant, based upon the final weight of the grease composition. In some embodiments, the antioxidant may be a mixture of about 0.3 to about 1.5% diarylamine and about 0.4 to about 2.5% high molecular weight phenol, by weight, based upon the final weight of the grease composition.

Examples of suitable olefins that may be sulfurized to form a sulfurized olefin include propylene, butylene, isobutylene, polyisobutylene, pentene, hexene, heptene, octene, nonene, decene, undecene, dodecene, tridecene, tetradecene, pentadecene, hexadecene, heptadecene, octadecene, nonadecene, eicosene or mixtures thereof. In an embodiment, hexadecene, heptadecene, octadecene, nonadecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulfurized olefin includes sulfurized fatty acids and their esters. The fatty acids are often obtained from vegetable oil or animal oil and typically contain about 4 to about 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. Fatty acids and/or ester may be mixed with olefins, such as α-olefins.

The one or more antioxidant(s) may be present in ranges of from about 0 wt. % to about 20 wt. %, or about 0.1 wt. % to about 10 wt. %, or about 1 wt. % to about 5 wt. %, of the lubricating composition.

Antiwear Agents

The grease composition of the present disclosure may comprise antiwear agents. Examples of suitable antiwear agents include, but are not limited to, a metal thiophosphate; a metal dialkyldithiophosphate; a phosphoric acid ester or salt thereof; a phosphate ester(s); a phosphite; a phosphorus-containing carboxylic ester, ether, or amide; a sulfurized olefin; thiocarbamate-containing compounds including, thiocarbamate esters, alkylene-coupled thiocarbamates, and bis(S-alkyldithiocarbamyl)disulfides; and mixtures thereof. The phosphorus containing antiwear agents are more fully described in European Patent No. 1490460. The metal in the dialkyl dithio phosphate salts may be an alkali metal, alkaline earth metal, aluminum, lead, tin, molybdenum, manganese, nickel, copper, titanium, or zinc. A useful antiwear agent may be a thiophosphate such as zinc dialkyldithiophosphate.

The antiwear agent may be present in ranges of from about 0 wt. % to about 15 wt. %, or about 0.01 wt. % to about 10 wt. %, or about 0.05 wt. % to about 5 wt. %, or about 0.1 wt. % to about 3 wt. % of the total weight of the grease composition. In certain embodiments, the additional antiwear agent(s) are in the form of amine salts and present in less than or equal to about 1.0 wt %, less than or equal to about 0.5 wt % or less than or equal to about 0.25 wt %. In other embodiments, the additional antiwear agents are not amine salts.

Extreme Pressure Agents

The grease composition herein also may optionally contain one or more extreme pressure agents. Extreme Pressure (EP) agents that are soluble in the oil include sulfur- and chlorosulfur-containing EP agents, chlorinated hydrocarbon EP agents and phosphorus EP agents. Examples of such EP agents include chlorinated waxes; organic sulfides and polysulfides such as dibenzyldisulfide, bis(chlorobenzyl) disulfide, dibutyl tetrasulfide, sulfurized methyl ester of oleic acid, sulfurized alkylphenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters such as the dihydrocarbyl and trihydrocarbyl phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenyl phosphite; metal thiocarbamates such as zinc dioctyldithiocarbamate and barium heptylphenol diacid; amine salts of alkyl and dialkylphosphoric acids, including, for example, the amine salt of the reaction product of a dialkyldithiophosphoric acid with propylene oxide; and mixtures thereof.

In one embodiment, the organic polysulfides are S-3 enriched organic polysulfides. As used herein, the phrase "S-3 enriched organic polysulfides" refers to organic polysulfides that contain more trisulfide species than monosulfide or other polysulfide species. In some embodiments, the S-3 enriched organic polysulfides contain at least 50 wt % trisulfides, or at least 55%, at least 60%, at least 65%, at least 75% or at least 80% trisulfides, with the remaining organic polysulfides being primarily S-2 and S-4 polysulfides. In certain embodiments, the S-3 enriched organic polysulfides contain almost 100% trisulfides. In some embodiments, the molar ratios of S-2:S-3:S-4 polysulfides are from about 10-30:50-80:10-30. In certain embodiments, the S-3 enriched organic polysulfides have hydrocarbyl groups each independently having from about 2 to about 30 carbons or from about 2 to about 20 carbons, or from about 2 to about 12 carbons or from about 3 to about 6 carbons. The hydrocarbyl groups can be aromatic or aliphatic, but are preferably aliphatic. In certain embodiments, the hydrocarbyl groups are alkyl groups. In one embodiment, the S-3 enriched organic polysulfides comprise at least 60% dihydrocarbyl trisulfide. In other embodiments, the organic polysulfides by weight % of the total polysulfides are from about 5 wt % to about 20 weight % S-2; from about 30 wt % to about 80 wt % S-3, and from about 5 wt % to about 50 wt % S-4. Examples of suitable S-3 enriched organic polysulfides include those disclosed in U.S. Pat. Nos. 6,642,187, 6,689,723, or 6,489,271.

Friction Modifiers

The grease composition herein may also optionally contain one or more additional friction modifiers. Suitable friction modifiers may comprise metal containing and metal-free friction modifiers and may include, but are not limited to, imidazolines, amides, amines, succinimides, alkoxylated amines, alkoxylated ether amines, amine oxides, amidoamines, nitriles, betaines, quaternary amines, imines, amine salts, amino guanidines, alkanolamides, phosphonates, metal-containing compounds, glycerol esters, sulfurized fatty compounds and olefins, sunflower oil and other naturally occurring plant or animal oils, dicarboxylic acid esters, esters or partial esters of a polyol and one or more aliphatic or aromatic carboxylic acids, and the like.

Suitable friction modifiers may contain hydrocarbyl groups that are selected from straight chain, branched chain, or aromatic hydrocarbyl groups or mixtures thereof, and may be saturated or unsaturated. The hydrocarbyl groups may be composed of carbon and hydrogen or hetero atoms such as sulfur or oxygen. The hydrocarbyl groups may range from about 12 to about 25 carbon atoms. In a embodiments the friction modifier may be a long chain fatty acid ester. In an embodiment the long chain fatty acid ester may be a mono-ester, or a di-ester, or a (tri)glyceride. The friction modifier may be a long chain fatty amide, a long chain fatty ester, a long chain fatty epoxide derivative, or a long chain imidazoline.

Other suitable friction modifiers may include organic, ashless (metal-free), nitrogen-free organic friction modifiers. Such friction modifiers may include esters formed by reacting carboxylic acids and anhydrides with alkanols and generally include a polar terminal group (e.g. carboxyl or hydroxyl) covalently bonded to an oleophilic hydrocarbon chain. An example of an organic ashless nitrogen-free friction modifier is known generally as glycerol monooleate (GMO) which may contain mono-, di-, and tri-esters of oleic acid. Other suitable friction modifiers are described in U.S. Pat. No. 6,723,685.

Aminic friction modifiers may include amines or polyamines. Such compounds can have hydrocarbyl groups that are linear, either saturated or unsaturated, or a mixture thereof and may contain from about 12 to about 25 carbon atoms. Further examples of suitable friction modifiers include alkoxylated amines and alkoxylated ether amines. Such compounds may have hydrocarbyl groups that are linear, either saturated, unsaturated, or a mixture thereof. They may contain from about 12 to about 25 carbon atoms. Examples include ethoxylated amines and ethoxylated ether amines.

The amines and amides may be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291.

A friction modifier may be present in amounts of about 0 wt. % to about 10 wt. %, or about 0.01 wt. % to about 8 wt. %, or about 0.1 wt. % to about 4 wt. %, based on the total weight of the grease composition.

Viscosity Index Improvers

The grease composition herein also may optionally contain one or more viscosity index improvers. Suitable viscosity index improvers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity index improvers may include star polymers and suitable examples are described in US Publication No. 2012/0101017 A1.

The grease composition herein also may optionally contain one or more dispersant viscosity index improvers in addition to a viscosity index improver or in lieu of a viscosity index improver. Suitable dispersant viscosity index improvers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity index improver and/or dispersant viscosity index improver may be about 0 wt. % to about 20 wt. %, about 0.1 wt. % to about 15 wt. %, about 0.1 wt. % to about 12 wt. %, or about 0.5 wt. % to about 10 wt. % based on the total weight, of the lubricating composition.

Effective amounts of the various additive components for a specific formulation may be readily ascertained, but for illustrative purposes these general guides for representative effective amounts are provided. The amounts below are given in weight % of the finished fluid.

Methods of Making Grease

One aspect of the invention described herein is a method for preparing a calcium sulfonate grease comprising the steps of a) providing preformed calcium acetate dissolved in water in a vessel, b) providing an oil of lubricating viscosity to the dissolved preformed calcium acetate in water in the vessel from step a), c) heating the oil and preformed calcium acetate mixture of step b), and d) providing overbased calcium sulfonate detergent to the oil and preformed calcium acetate mixture in the vessel from step c). In one embodiment, the method is for preparation of a simple grease. In another embodiment, the method is for preparation of a complex grease.

This method may occur in either an open or closed kettle as is commonly used for grease manufacturing. The process can be achieved at normal atmospheric pressure although can be carried out under pressure in a closed kettle. In one embodiment, the method is carried out in open kettles.

In one embodiment the method further comprises e) adding one or more complexing acids to the mixture of step d), and f) adding one or more converting agents to the mixture of step e). In some embodiments, two or more of steps a) through f) of the method are performed in order. In another embodiment, all of steps a) through f) are performed in order.

In one embodiment, the preformed calcium acetate used in the method is a calcium acetate powder dissolved in water. In another embodiment, the amounts of calcium acetate powder and water are about one part calcium acetate powder dissolved in about ten parts water. In another embodiment, the preformed calcium acetate is prepared from a basic calcium source and an acid prior to the addition of any base oil.

In one embodiment, the greases of the present invention have the consistency of common greases as classified by the National Lubricating Grease Institute (NLGI). Common greases have NLGI categorization of 1-3, corresponding to a penetration of about 230 to about 340 as measured by ASTM D217. In certain embodiments, the grease is a complex grease with a penetration of about 230 to about 340 as measured by ASTM D217. In other embodiments, the complex grease has a penetration of from about 265 to about 295 as measured by ASTM D217.

As understood by the skilled artisan, the simple greases described herein may be used to form complex greases with the addition of saponification agents, such as lime, complexing acids, such as 12-HSA, and additional base oil. The complex greases prepared from the simple greases will generally have somewhat higher penetration scores than the simple greases from which they are prepared due to the additional volume of base oil and additional components, but will maintain the desired dropping point. The higher penetration scores of the complex greases are still within NLGI categories 1-3, and in certain embodiments are in NLGI category 2.

The dropping point of a lubricating grease is an indication of the heat resistance of the grease and is the temperature at which it passes from a semi-solid to a liquid state under specific test conditions. The dropping point indicates the upper temperature limit at which a grease retains its structure though is not necessarily the maximum temperature at which a grease can be used. In one embodiment, the complex grease of the invention has a dropping point of from about 250° C. to about 400° C. as measured by ASTM D2265.

The composition of greases can be characterized by Fourier transformed infrared (FTIR) spectroscopy. In one embodiment, infrared spectra of the greases of the instant invention comprise an absorbance peak at 1569 $cm^{-1}$±1. In another embodiment, the infrared spectra of the greases further comprises an absorbance peak at 883 $cm^{-1}$±1. The presence of a peak at about 1569 $cm^{-1}$ is characteristic of a carbonyl peak and demonstrates incorporation of calcium acetate into the grease structure with relative intensity of the peaks corresponding to relative calcium acetate content of each batch. The presence of a peak at about 883 $cm^{-1}$ is characteristic of a calcite peak and demonstrates the presence of a calcite allotrope of $CaCO_3$.

The relationship of peak intensity (percent transmission or % T) of the characteristic carbonyl peak at 1569 $cm^{-1}$±1 and the grease penetration as measured by ASTM D217 is generally a linear relationship. In certain embodiments, the ratio of peak intensity (% T) at 1569±1 to penetration as measured by ASTM D217 is from about 1:2.4 to about 1:3.4.

Although certain embodiments of the present disclosure may be described individually herein, it is understood by the skilled artisan that any one embodiment can be combined with any other embodiment or embodiments, and such combinations are within the scope of the instant disclosure.

EXAMPLES

Example 1

Preparation of Batch 1 Complex Grease Composition Using Preformed Anhydrous Calcium Acetate Calcium sulfonate complex greases are prepared as described in Table 1 as Batch 1 using the following procedure: Anhydrous calcium acetate (AVA Chemical Pvt Ltd, Mumbai, Maharashtra—CAS Number-62-54-4; 5743-26-0) is placed in an open mixing vessel. Water (approximately 10× of the amount of calcium acetate) is added to the vessel to completely disperse the calcium acetate. Base oil (20% of the total amount) is added to the vessel containing the calcium acetate solution and the mixture is heated to a temperature of 80° C. Calcium sulfonate (Afton Chemical—HiTEC® 611, 307 TBN) is added to the vessel with stirring and the mixture is maintained at a temperature of approximately 85° C.

Dodecyl benzene sulfonic acid (Afton Chemical—HiTEC®052) is added with stirring until the material becomes viscous. 2-ethoxy-ethanol (Labort Finechem Pvt Ltd, Gujarat—CAS Number 110-80-5) is added with mixing and the temperature is maintained at approximately 90-95° C. The mixture is stirred continuously for approximately 1.5-2.0 hours at approximately 90-95° C. The mass is observed and the mixture is stirred until the mixture becomes transparent. The process of converting amorphous calcium carbonate to crystalline calcite can be monitored either by visual appearance or by FT-IR spectroscopy. Amorphous calcium carbonate absorbs at 863 $cm^{-1}$. Calcite absorbs at 883-884 $cm^{-1}$. Up to half of the remaining base oil is added if needed to achieve the desired transparent mixture.

The mixture is slowly (30-45 minutes) heated to 125° C. Lime and a minimal amount of water is stirred in a separate vessel to form a slurry. The lime/water slurry is added slowly to the main vessel with stirring. The mixture is heated to return the temperature of the mixture to approximately 125-130° C. 12-hydroxystearic acid (12 HSA) is added with stirring until the mixture becomes thick and the thickened mixture is heated to 140° C. Small amounts of water are added as needed to complete the saponification of the 12-hydroxystearic acid. The mixture is slowly heated to approximately 180-185° C. The temperature of the mixture is held at approximately 180-185° C. for about 10 minutes and then cooled to around 130° C. The remaining base oil is added with stirring to achieve the desire consistency and the grease mixture is cooled completely.

The grease is passed through a vertical colloidal milling machine (with 0.1 mm clearance) for single pass to achieve a final smooth homogenous texture. Fourier Transform Infrared Spectroscopy (FT-IR) is performed on Batch 1 and yielded infrared spectra according to FIG. 1. Dropping point (ASTM D2265), penetration (ASTM D217), four ball weld load (IP239), wear scar diameter (ASTM D2266) and reaction time to form a grease is determined for each grease batch. The results are summarized in Table 2.

Example 2

Preparation of Batches 2-6 simple grease compositions using preformed anhydrous calcium acetate.

Simple calcium sulfonate greases, Batches 2-6, are prepared as described in Table 1 using the procedure of Example 1, except the complexing agent, 12 HSA, and lime are not added during grease formation. These experiments are carried out to see the effect of using preformed calcium acetate during the formation of simple calcium sulfonate greases.

Results are shown in Table 4.

TABLE 1

| Component (parts)* | Batch 1 | Batch 2 | Batch 3 | Batch 4 | Batch 5 | Batch 6 |
|---|---|---|---|---|---|---|
| Calcium acetate | 1.5 | 0.5 | 1 | 1.5 | 2 | 3 |
| Overbased calcium sulfonate detergent | 26 | 26 | 26 | 26 | 26 | 26 |
| Dodecyl benzene sulfonicsulfonic acid | 2.5 | 2.5 | 2.5 | 2.5 | 2.5 | 2.5 |
| 2-Ethoxy Ethanol | 2.0 | 2.0 | 2.0 | 2.0 | 2.0 | 2.0 |
| Lime | 1.0 | | | | | |
| 12 HSA | 5.0 | | | | | |
| Total Ca amount in final grease | 4.25 | 3.21 | 3.33 | 3.45 | 3.58 | 3.84 |
| Base Oil Brightstock-150 | 62 | 20 | 20 | 20 | 20 | 20 |

*All components are listed in parts for ease of comparison of the amount of calcium acetate in the complex grease (Batch 1) versus the simple greases (Batches 2-6). Batches 2-6 can be used to form complex greases, for example, with the addition of lime, 12 HSA and the balance base oil.

TABLE 2

| Performance characteristics | | | | | | |
|---|---|---|---|---|---|---|
| | Batch 1 | Batch2 | Batch 3 | Batch 4 | Batch 5 | Batch 6 |
| Drop point (° C.) | 296 | >380 | >380 | >320 | 333 | 320 |
| Penetration x 60 | 287 | 327 | 318 | 256 | 237 | 230 |
| Weld load (kgf) | 315 | 225 | 225 | 250 | 355 | 400 |
| WSD (mm) | 0.51 | 0.52 | 0.54 | 0.52 | 0.46 | 0.43 |
| Reaction time to form grease (minutes) | 480 | 90 | 90 | 90 | 90 | 90 |

Figure 2:
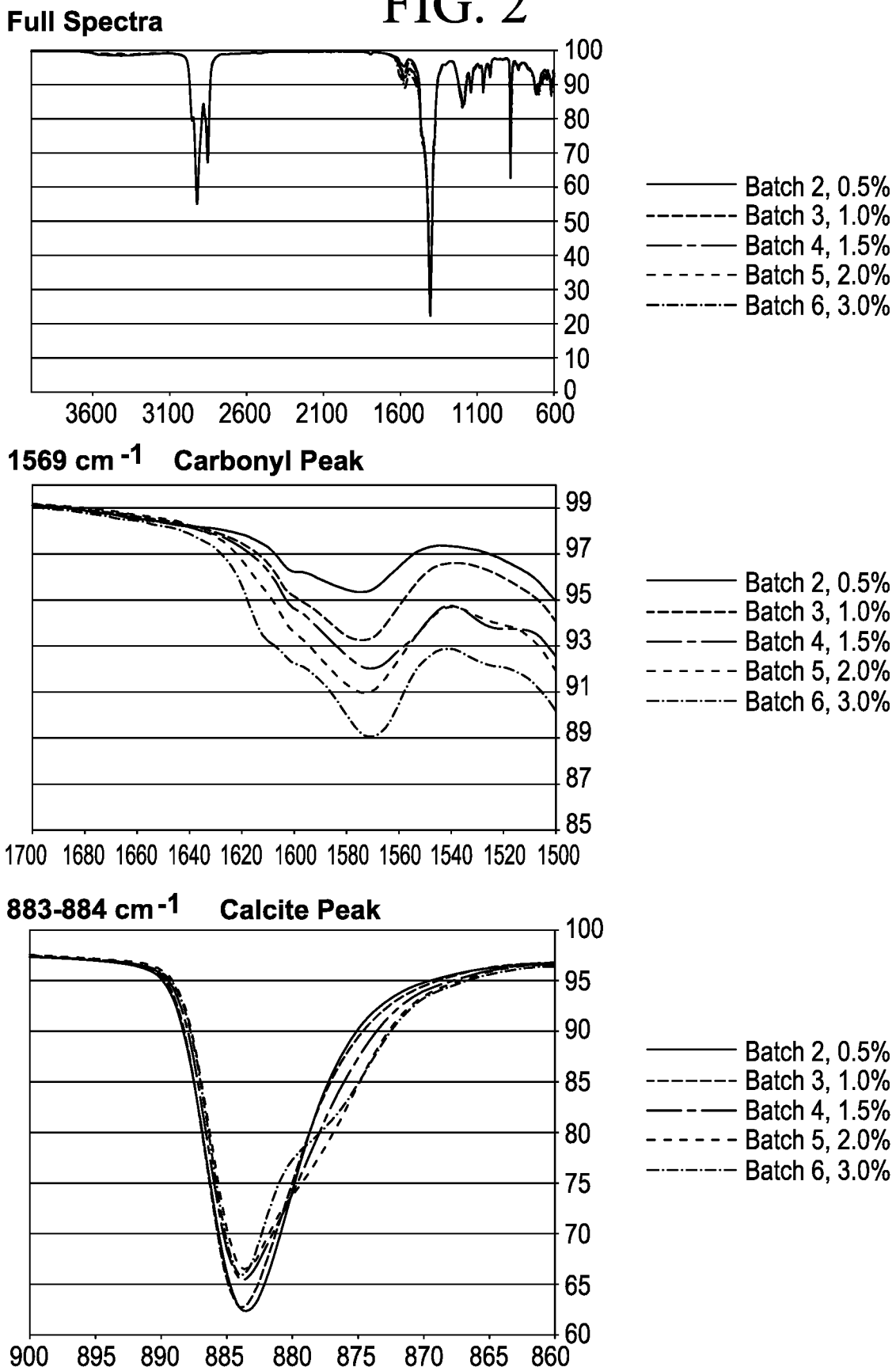
FIG. 2 is FTIR spectra of multiple embodiments described herein.

Fourier Transform Infrared Spectroscopy was performed on Examples 2-6 and yielded infra-red spectra according to FIG. 2. As shown in FIG. 2, Batches 2-6 had a characteristic carbonyl peak at ~1569 $cm^{-1}$ demonstrating incorporation of calcium acetate into the grease structure with relative intensity of the peaks corresponding to relative calcium acetate content of each batch. All batches also had a characteristic calcite peak at 883-884 $cm^{-1}$ demonstrating the presence of the calcite allotrope of $CaCO_3$. The ratio of peak intensity to penetration score suggests a linear relationship. The results are summarized in Table 3.

TABLE 3

| Components | Batch 2 | Batch 3 | Batch 4 | Batch 5 | Batch 6 |
|---|---|---|---|---|---|
| Ratio of calcium acetate to overbased calcium sulfonate detergent | 1:52 | 1:26 | 1:17 | 1:13 | 1:7 |
| Peak intensity (% T) | 95 | 93 | 92 | 91 | 89 |
| Ratio of peak intensity to penetration (ASTM D217) | 1:3.4 | 1:3.4 | 1:2.8 | 1:2.6 | 1:2.6 |

Example 3

Preparation of Simple Calcium Sulfonate Greases Prepared Using Performed Calcium Acetate Prepared Prior to the Addition of Base Oil.

Batch 7 is prepared according to Table 4 using the procedure of Example 2, except that instead of placing anhydrous calcium acetate in the vessel and dissolving it in water, finely divided calcium carbonate with a mean particle size below 5 microns (Riddhi Chemicals, Mumbai, Maharashtra—CAS Number-471-34-1) is added to the mixing vessel. Water (approximately 5× of the amount of calcium carbonate) is added to the vessel to completely disperse the calcium carbonate and this mixture is mixed with glacial acetic acid (Riddhi Chemicals, Mumbai, Maharashtra—CAS Number-64-19-7) in the vessel prior to adding the base oil.

Batch 8 is prepared according to Table 4 using the procedure of Example 1, except that instead of placing anhydrous calcium acetate in the vessel and dissolving it in water, finely divided food grade purity calcium hydroxide base with a mean particle size of about 4 microns (Riddhi Chemicals, Mumbai, Maharashtra—CAS Number-1305-62-0) is added to the mixing vessel. Water (approximately 5× of the amount of calcium hydroxide) is added to the vessel to completely disperse the calcium hydroxide and this mixture is mixed with glacial acetic acid in the vessel prior to adding the base oil.

The results of Batches 7 and 8 are shown in Table 5.

TABLE 4

| Components (parts) | Batch 7 | Batch 8 |
|---|---|---|
| Calcium carbonate | 2.0 | |
| Calcium hydroxide | | 0.70 |
| Glacial acetic acid | 2.5 | 1.14 |
| Overbased calcium sulfonate detergent | 26 | 26 |
| Dodecyl benzene sulfonic acid | 2.5 | 2.5 |
| 2-ethoxy-ethanol | 2.0 | 2.0 |
| Total Ca amount in final grease | 3.88 | 3.46 |
| Base Oil Brightstock-150 | 20 | 20 |
| Calcium acetate formed | 3 | 1.5 |

TABLE 5

| Performance characteristics | | |
|---|---|---|
| | Batch 7 | Batch 8 |
| Drop point (° C.) | 304 | 306 |
| Penetration × 60 | 223 | 266 |
| Weld load (kgf) | 500 | 250 |
| WSD (mm) | 0.41 | 0.52 |
| Reaction time (minutes) | 180 | 120 |

Figure 3:
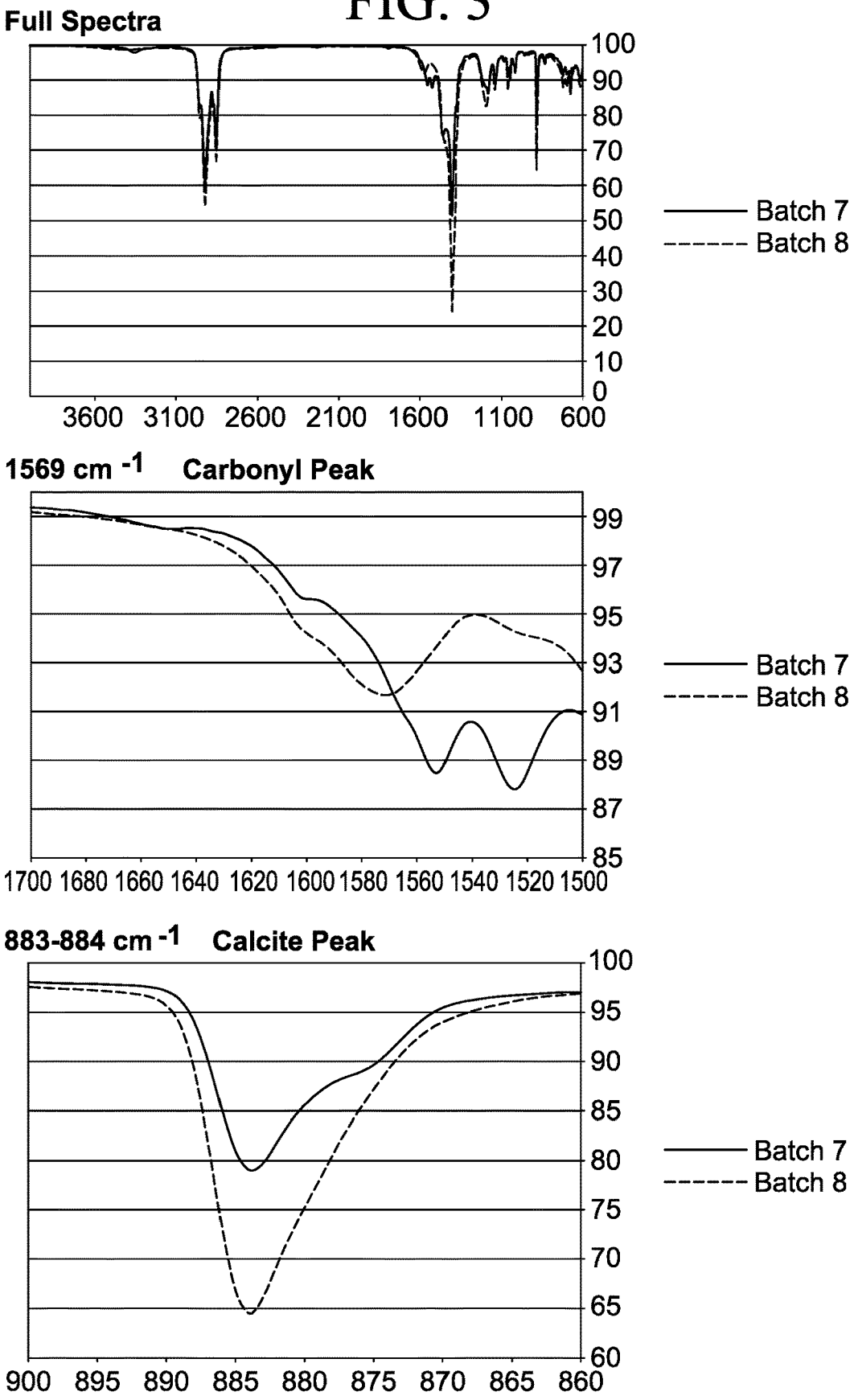
FIG. 3 is FTIR spectra of two embodiments described herein.
Figure 4:
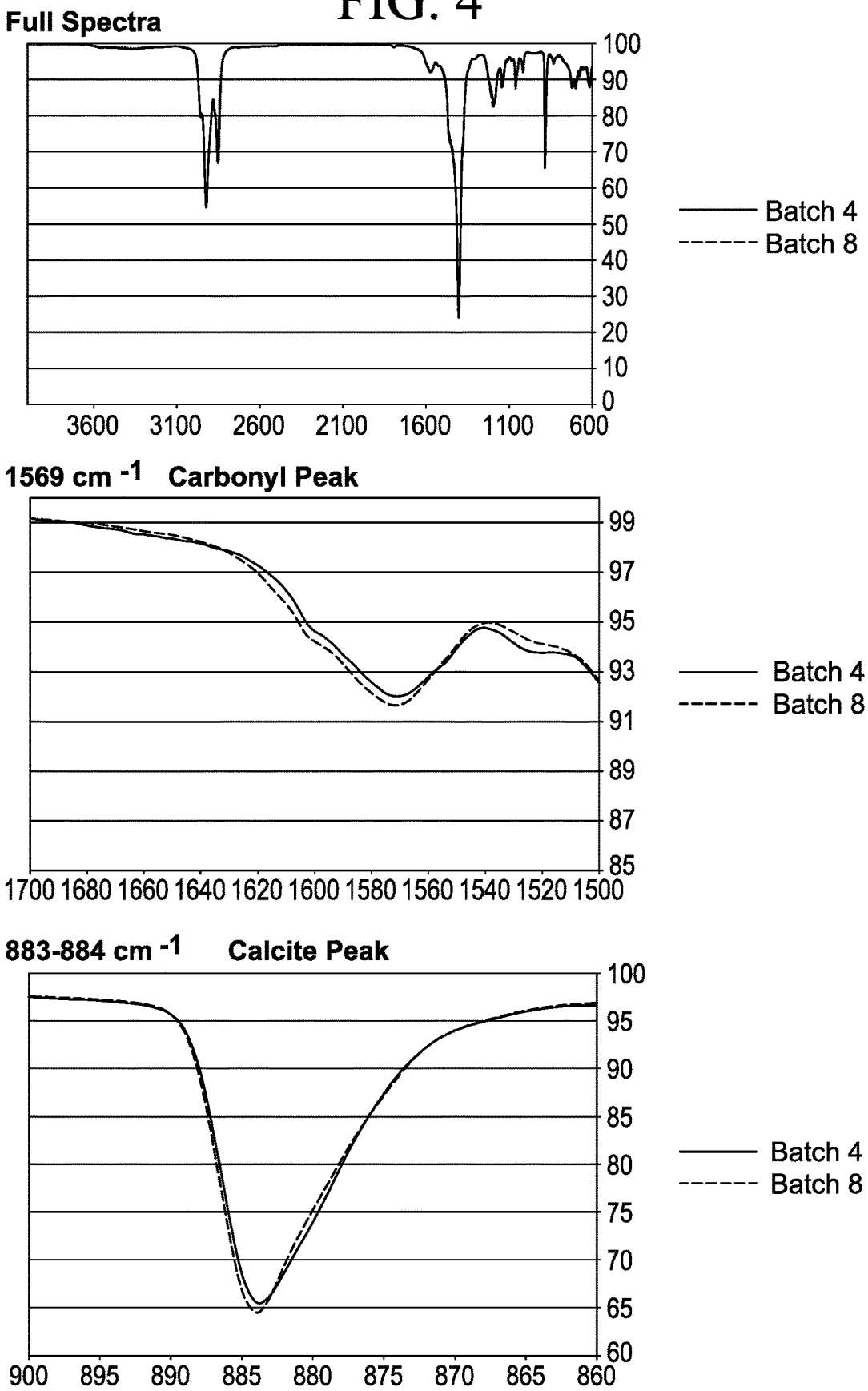
FIG. 4 is FTIR spectra of two embodiments described herein.

Fourier Transform Infrared Spectroscopy of Batch 7 and Batch 8 yielded IR spectra according to FIG. 3. A comparison of Batch 4 and Batch 8 shows identical infra-red spectra with both the characteristic carbonyl peak at ~1569 $cm^{-1}$, and the characteristic calcite peak at 883-884 $cm^{-1}$ as shown in FIG. 4.

Example 4 (Comparative)

Simple calcium sulfonate greases, Batches 9 and 10, are prepared according to Table 6 using the procedure of Example 2, except that instead of placing anhydrous calcium acetate in the vessel and dissolving it in water, water alone (Batch 9) or water and glacial acetic acid (Batch 10) are placed in the vessel and mixed with the base oil.

As shown in Table 7, the grease produced by this method exhibited higher reaction times, lower dropping points and higher penetration scores as compared to the greases of the invention.

TABLE 6

| Components (wt %) | Batch 9 | Batch 10 |
|---|---|---|
| Glacial acetic acid | — | 1.14 |
| Overbased calcium sulfonate detergent | 26.0 | 26.0 |
| Dodecyl benzene sulfonic acid | 2.5 | 2.5 |
| 2-ethoxy-ethanol | 2.0 | 2.0 |
| Total Ca amount in final grease | 3.08 | 3.08 |
| Base Oil Brightstock-150 | 20 | 20 |
| Theoretical calcium acetate formed | — | 1.5 |

TABLE 7

| Performance characteristics | | |
|---|---|---|
| | Batch 9 | Batch 10 |
| Drop point (° C.) | 290 | 302 |
| Penetration × 60 | 463 | 369 |
| Weld load (kgf) | 225 | 250 |
| WSD (mm) | 0.53 | 0.51 |
| Reaction time (minutes) | 120+ | 120+ |

Figure 5:
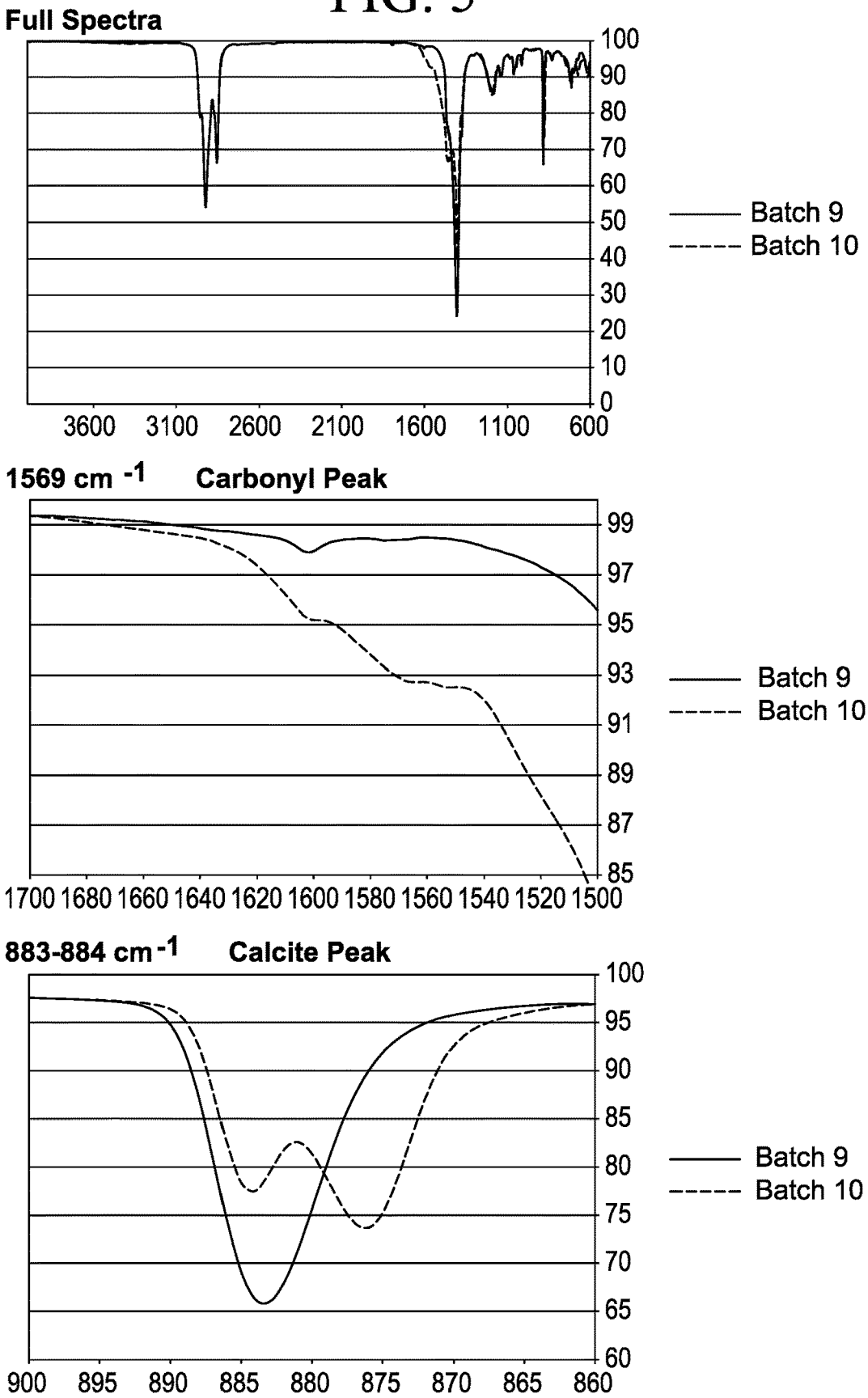
FIG. 5 is FTIR spectra of comparative compositions relative to embodiments described herein.

Fourier Transform Infrared Spectroscopy of Batches 9 and 10 yielded IR spectra according to FIG. 5.

What is claimed is:

1. A complex grease comprising:

a. preformed calcium acetate from about 0.25 wt % to about 5 wt %;

b. an overbased calcium sulphonate detergent from about 10 wt % to about 30 wt %;

c. an oil of lubricating viscosity; and d. one or more converting agents comprising 2-ethoxy ethanol.

2. The complex grease of claim 1, wherein the complex grease has a penetration of about 230 to about 340 as measured by ASTM D217.

3. The complex grease of claim 1, wherein the complex grease has a drop point of from about 250° C. to about 400° C.

4. The complex grease of claim 1, wherein an infrared spectrum of the grease comprises an absorbance peak at 1569 $cm^{-1}$±1.

5. The complex grease of claim 4, wherein the infrared spectrum of the grease further comprises an absorbance peak at 883 $cm^{-1}$±1.

6. The complex grease of claim 1, wherein the ratio of preformed calcium acetate to overbased calcium sulphonate detergent is from about 1:2 to about 1:100.

7. The complex grease of claim 1, wherein the ratio of peak intensity (% T) of the absorbance peak at 1569 $cm^{-1}$±1 to grease penetration measured by ASTM D217 is from about 1:2.4 to about 1:3.4.

8. The complex grease of claim 1, wherein the preformed calcium acetate is from about 0.5 wt % to about 3.5 wt %.

9. The complex grease of claim 1, wherein the overbased calcium sulphonate detergent is from about 20 wt % to about 30 wt %.

10. The complex grease of claim 1, wherein the oil of lubricating viscosity is selected from the group consisting of group I, group II, group III, group IV and group V oils, or is selected from a mixture of one or more oils of group I, group II, group III, group IV and group V base oils.

11. The complex grease of claim 1, wherein the overbased calcium sulphonate detergent has a total base number (TBN) from about 300 to about 400.

12. The complex grease of claim 1, wherein the complex grease further comprises one or more complexing acids selected from the group consisting of a long chain carboxylic acid, a short chain carboxylic acid, boric acid, phosphoric acid, and alkyl benzene sulphonic acid.

13. The complex grease of claim 12, wherein at least one of the complexing acids is $C_1$-$C_{20}$ alkyl benzene sulphonic acid.

14. The complex grease of claim 13, wherein the $C_1$-$C_{20}$ alkyl benzene sulphonic acid is dodecylbenzene sulfonic acid.

15. The complex grease of claim 12, wherein the complex grease comprises at least two complexing acids.

16. The complex grease of claim 15, wherein the at least two complexing acids comprise dodecylbenzene sulfonic acid and 12-hydroxystearic acid.

17. The complex grease of claim 1, wherein the complex grease further comprises one or more additives selected from the group consisting of antioxidants, rust inhibitors, metal deactivators, antiwear agents, antiscuffing agents, extreme pressure agents, foam inhibitors, demulsifiers, friction modifiers, viscosity modifiers, and pour point depressants.

18. A method for preparing a calcium sulfonate grease comprising the steps of:

a) providing preformed calcium acetate dissolved in water in a vessel;

b) providing an oil of lubricating viscosity to the dissolved preformed calcium acetate in water in the vessel from step a), c) heating the oil and preformed calcium acetate mixture of step b); and d) providing an overbased calcium sulfonate detergent to the oil and preformed calcium acetate mixture in the vessel from step c).

19. The method of claim 18, wherein the method further comprises:

e) adding one or more complexing acids to the mixture of step d); and f) adding one or more converting agents to the mixture of step e).

20. The method of claim 18, wherein the steps of the method are performed in order.

21. The method of claim 19, wherein the steps of the method are performed in order.

22. The method of claim 18, wherein the preformed calcium acetate dissolved in the water is calcium acetate powder.

23. The method of claim 22, wherein the preformed calcium acetate dissolved in the water is in an amount of about one part calcium acetate powder dissolved in about ten parts water.

24. The method of claim 18, wherein the overbased calcium sulphonate detergent has a total base number (TBN) of from about 300 to about 400.

25. The method of claim 19, wherein the one or more complexing acids is selected from the group consisting of a long chain carboxylic acid, a short chain carboxylic acid, boric acid, phosphoric acid, and alkyl benzene sulphonic acid.

26. The method of claim 25, wherein the complexing acid is $C_1$-$C_{20}$ alkyl benzene sulphonic acid.

27. The method of claim 26, wherein the $C_1$-$C_{20}$ alkyl benzene sulphonic acid is dodecylbenzene sulfonic acid.

28. The method of claim 19, wherein the method comprises adding at least two complexing acids.

29. The method of claim 28, wherein the at least two complexing acids comprise dodecylbenzene sulfonic acid and 12-hydroxystearic acid.

30. The method of claim 19, wherein the one or more converting agents is selected from the group consisting of alcohols, ethers, glycols, glycol ethers, glycol polyethers, carboxylic acids, inorganic acids, organic nitrates, compounds that contain active hydrogen, and compounds that contain tautomeric hydrogen.

31. The method of claim 30, wherein the one or more converting agents is selected from the group consisting of isopropyl alcohol and ethoxy ethanol.

32. The method of claim 31, where the one or more converting agents is 2-ethoxy ethanol.

33. A grease prepared by the method of claim 18, further comprising one or more converting agents comprising 2-ethoxy ethanol.

34. The grease of claim 33, wherein the grease has a penetration of about 230 to about 340 as measured by ASTM D217.

35. The grease of claim 33, wherein an infrared spectrum of the grease comprises an absorbance peak at 1569 $cm^{-1}$±1.

36. The grease of claim 35, wherein an infrared spectrum of the grease further comprises an absorbance peak at 883 $cm^{-1}$±1.

37. The grease of claim 33, wherein the ratio of peak intensity (% T) of the absorbance peak at 1569 $cm^{-1}$±1 to grease penetration measured by ASTM D217 is from about 1:2.4 to about 1:3.4.

38. The complex grease of claim 1, wherein the overbased calcium sulphonate detergent is present in an amount of at least about 10 wt %.

* * * * *